United States Patent [19]

Stanko

[11] Patent Number: 4,736,689

[45] Date of Patent: Apr. 12, 1988

[54] RETRACTABLE SHELF ASSEMBLY

[75] Inventor: John Stanko, Conway, Ark.

[73] Assignee: Tiffany Industries, Inc., St. Louis, Mo.

[21] Appl. No.: 684,503

[22] Filed: Dec. 21, 1984

[51] Int. Cl.[4] ..... A47F 5/12

[52] U.S. Cl. ..... 108/5; 108/143; 312/246; 312/323

[58] Field of Search ..... 312/322, 133, 323, 311, 312/348, 208, 246; 108/143, 96, 102, 106, 4, 5, 6, 10, 110, 144, 108; 403/4

[56] References Cited

U.S. PATENT DOCUMENTS

| | | | |
|---|---|---|---|
| 1,902,425 | 3/1933 | Stonges | 312/348 |
| 2,556,612 | 6/1951 | Buntin | 312/348 |
| 2,819,141 | 1/1958 | Myer | 312/323 |
| 4,316,082 | 2/1982 | Fritz | 312/208 |
| 4,379,429 | 4/1983 | Gubbe et al. | 108/5 |
| 4,441,432 | 4/1984 | Carlton | 108/5 |
| 4,483,572 | 11/1984 | Story | 312/208 |
| 4,515,086 | 5/1985 | Kwiecinski | 108/143 |

FOREIGN PATENT DOCUMENTS

| | | | |
|---|---|---|---|
| 78458 | 2/1931 | Sweden | 108/4 |

*Primary Examiner*—Kenneth J. Dorner
*Assistant Examiner*—Gerald A. Anderson
*Attorney, Agent, or Firm*—Cohn, Powell & Hind

[57] ABSTRACT

A housing adapted to be mounted beneath the top of a table and a shelf sized to fit substantially within the housing are operatively connected by a pair of telescoping rails which guide movement of the shelf between a retracted position in which the shelf is substantially within the housing and an extended position in which the shelf has a substantial portion thereof outside the housing. The rails pivot about an axis to change the height of the shelf with respect to the top of the table and the entire assembly includes a mechanism for securing the shelf in the extended position. The housing includes a vertically stepped slot in which a pin secured to the rails is movable to hold the shelf at predetermined heights with respect to the top of the table corresponding to the steps of the vertically stepped slot.

15 Claims, 4 Drawing Sheets

RETRACTABLE SHELF ASSEMBLY

BACKGROUND OF THE INVENTION

This invention relates generally to a retractable shelf for use with a table, and particularly to one which is suited for storing equipment such as a computer terminal keyboard in one position and presenting it to the user in a second position.

Tables with shelves which are movable from a position beneath the table top out to a position in which the contents of the shelf or drawer are exposed are, of course, known. Such table and shelf combinations, however, are not ideally suited for the situation where one wants to use a CRT (cathode ray tube) terminal on top of the table while having its separable typewriter-like keyboard semi-permanently mounted in the shelf or drawer. For example, while one is using the keyboard a force is exerted on the keyboard which might tend to push the shelf back under the table top. Moreover, the height of the shelf holding the keyboard may not be suitable for all users of the CRT. Presently known shelves are not easily adjustable to a number of different heights to accommodate different users and different user preferences.

Patents in this general field include coassigned U.S. Pat. No. 4,441,432 to Carlton for a tilting table. The Carlton patent, however, does not show an adjustable shelf for a keyboard. The disclosure of the Carlton patent is incorporated herein by reference since it illustrates a table with which the present invention can readily be used. U.S. Pat. Nos. 2,788,253 to Gussack and 4,258,967 to Boudreau show slide brackets for carrying a chassis containing electronic instruments by means of which the chassis may be slid out of positon and then pivotally swung around an angle to expose the bottom of the electronic components for service. U.S. Pat. No. 4,368,866 to Urban shows a pair of slots used for controlling the height and angle of inclination of an electrical accessory such as a radio. And U.S. Pat. No. 4,460,145 to Ando is directed to a bi-level book holder, which includes one generally horizontal slot in which a pivot pin runs in a generally vertical slot with two steps (see for example FIG. 8 and FIG. 22) None of these patents is believed to solve the disadvantages of the table and shelf combinations listed above.

SUMMARY OF THE INVENTION

Among the several aspects and features of the present invention are the provision of a retractable shelf assembly for a computer work station table and the like which allows the shelf to be latched in the extended position in which the keyboard housed therein is usable; the provision of such a shelf assembly in which the height of the shelf in the in-use position is easily and readily adjustable; the provision of such a shelf assembly which is readily movable as desired between the retracted position beneath the table and the extended position spaced from the table; and the provision of such a shelf assembly which is relatively economical and convenient to manufacture.

Briefly, the retractable shelf assembly of the present invention comprises a housing adapted to be mounted beneath the top of a table, a shelf sized to fit substantially within the housing, and rail means for guiding movement of the shelf between a retracted position in which the shelf is substantially within the housing and an extended position in which the shelf has a substantial portion thereof outside the housing to provide a work surface spaced from the top of the table. Pivot means secure the rail means to the housing for providing an axis about which the shelf may be rotated to change the height of the shelf with respect to the top of the table. Means are also provided for securing the shelf in the extended position. Either the housing or rail means has a vertically stepped slot therein and the other of the housing and the rail means has a pin secured thereto and movable in the vertically stepped slot to hold the shelf at predetermined heights with respect to the top of the table, which predetermined heights correspond to the steps of the slot. Other aspects and features will be in part apparent and in part pointed out hereinafter.

BRIEF DESCRIPTION OF THE DRAWINGS

Similar reference characters indicate similar parts throughout the various views of the drawings.

DESCRIPTION OF THE PREFERRED EMBODIMENT

Figure 1:
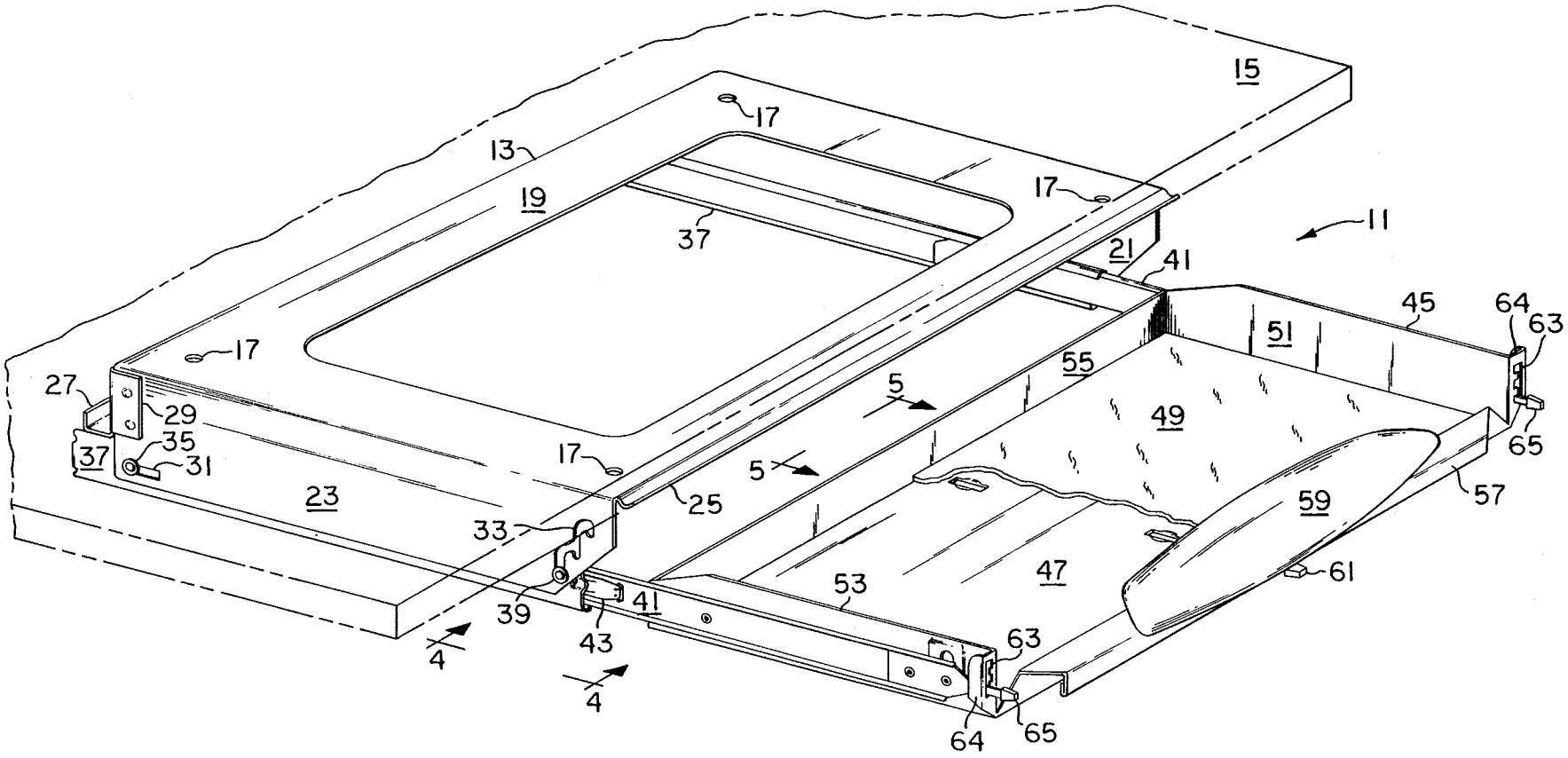
FIG. 1 is a perspective of the retractable shelf assembly of the present invention with the shelf in its extended position.

Turning now to the drawings, a retractable shelf assembly 11 (FIG. 1) includes a housing 13 of sheet metal or some other suitable material adapted to be mounted beneath the top of a table 15 (shown in phantom) such as the top of a table for a computer workstation. Screw holes 17 are shown for mounting the housing to the table top although any number of conventional mounting means may be employed. Housing 13 includes a top 19 from which depend right and left sidewalls 21 and 23. Top 19 has a central opening which reduces the weight of the housing and the amount of material needed to make the housing. Top 19 also includes a lip 25 disposed to fit along the edge of table top 15. A generally J-shaped flange 27 extends along the back of housing 13 to provide rigidity to the housing.

Flange 27 is secured to the right and left sides 21 and 23 of housing 13 at a pair of ears 29 (in order to eliminate unnecessary views, where parts like ear 29 which are present on the left and right sides of the shelf assembly are the same or mirror images, only one is shown). Both the right and left hand side of housing 13 include a generally horizontally extending slot 31 and a vertically stepped slot 33. Although three steps are shown in slot 33, more or fewer could be provided as desired. It is necessary however, that the horizontal extent of horizontal slot 31 be at least as large as the horizontal extent of vertically stepped slot 33.

A pair of pivot pins 35 ride in corresponding slots 31 and are secured to a pair of standard drawer slide rails 37. Each drawer slide rail 37 has a second pin 39 fixedly secured thereto which rides in vertically stepped slot 33 of the corresponding side of the housing. Slide rails 37 are generally C-shaped in cross section and allow a pair of inner rails 41 to telescope therein from the position shown in FIG. 1 to the position shown in FIG. 3 and back. A latching mechanism 43 is provided on the left and right hand sides to secure the inner rails in the extended position shown in FIG. 1.

Inner rails 41 support a shelf 45 sized to fit substantially within housing 13. Shelf 45 is made of sheet metal or some other suitable material. The shelf has a bottom 47 preferrably covered with a layer 49 of a suitable non-skid material. Right and left sidewalls 51 and 53 extend upwardly from bottom 47 and provide the points for attachment of inner rails 41. The shelf also has a back 55 extending up from bottom 47 and a front flange 57 which supports a palm rest 59. Immediately beneath palm rest 59 is a lever 61 for manually releasing latches 43. Right side 51 and left side 53 of shelf 45 include at their forward ends a pair of vertically stepped slots 63 which in cooperation with a pair of levers 65 extending from the front ends of inner rails 41 allow the tilt of the shelf to be adjusted and the shelf to be leveled. More specifically, sides 51 and 53 terminate in generally C-shaped flanges 64 in which vertically stepped slots 63 are disposed.

Figure 2:
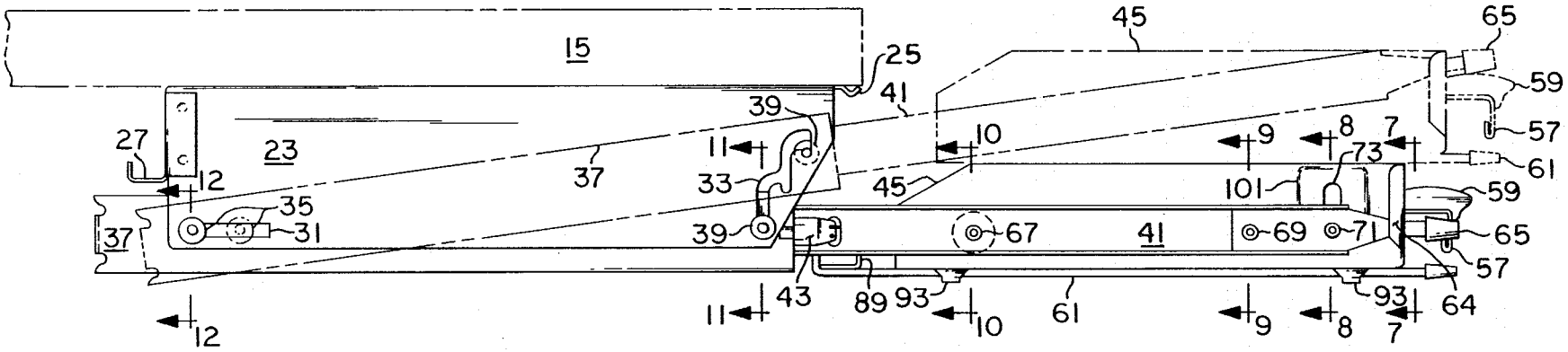
FIG. 2 is a side elevation of the retractable shelf assembly of the present invention illustrating the height adjustment feature of the present invention in phantom.

Turning now to FIG. 2, the height and leveling adjustment features of the present invention are illustrated. The solid lines in FIG. 2 illustrate the extended position of the shelf at its lowest height. To increase the height one pulls rails 37 and 41 upwardly and outwardly so that rail 37 pivots around pivot pin 35 and pin 39 is moved to one of the higher vertical steps of vertically stepped slot 35. The phantom lines in FIG. 2 illustrate the situation when the rails have been pulled upwardly and outwardly until pin 39 rest in the highest step of slot 33. As the rails are pulled outwardly, pivot pin 35 also slides in slot 31 to the position shown in phantom. However, merely pulling the rails upwardly and outwardly would result in the shelf 45 being disposed at an angle other than horizontal with respect to the table top. For many applications this is undesirable. By moving levers 65 from the position shown in solid in FIG. 2 to the position shown in phantom in FIG. 2 the user can again level the shelf. This is because shelf 45 is pivotable with respect to rails 41 around a pivot pin 67. Levers 65 are secured to rails 41 by a further pair of pins 69 and 71, neither of which restrict the motion of the rail with respect to the shelf. Pin 69 does not extend to the wall of the shelf and pin 71 rides freely in a slot 73 in its respective sidewall. Thus it can be seen for each of the three possible heights of the shelf as set by slot 33, there is a corresponding leveling step in slot 63. Alternatively, levers 65 can be used to adjust the angle of the shelf to a preset angle other than horizontal if desired.

Figure 3:
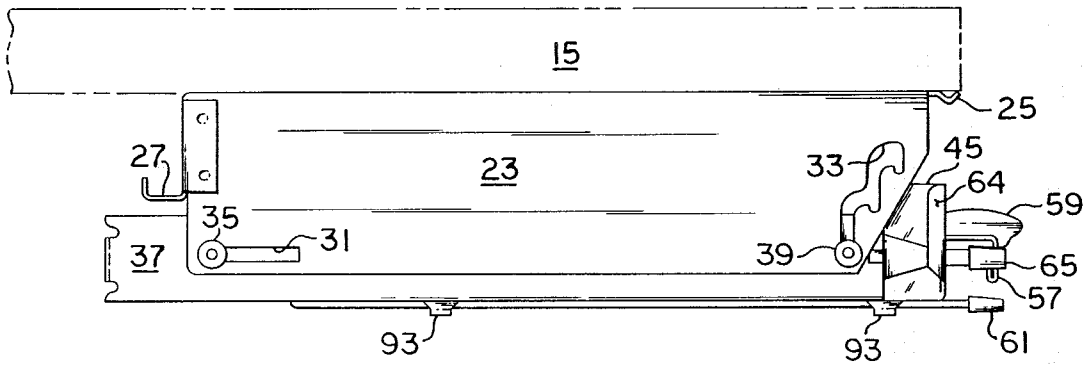
FIG. 3 is a side elevation of the retractable shelf assembly of the present invention showing the shelf in its retracted position.
Figure 4:
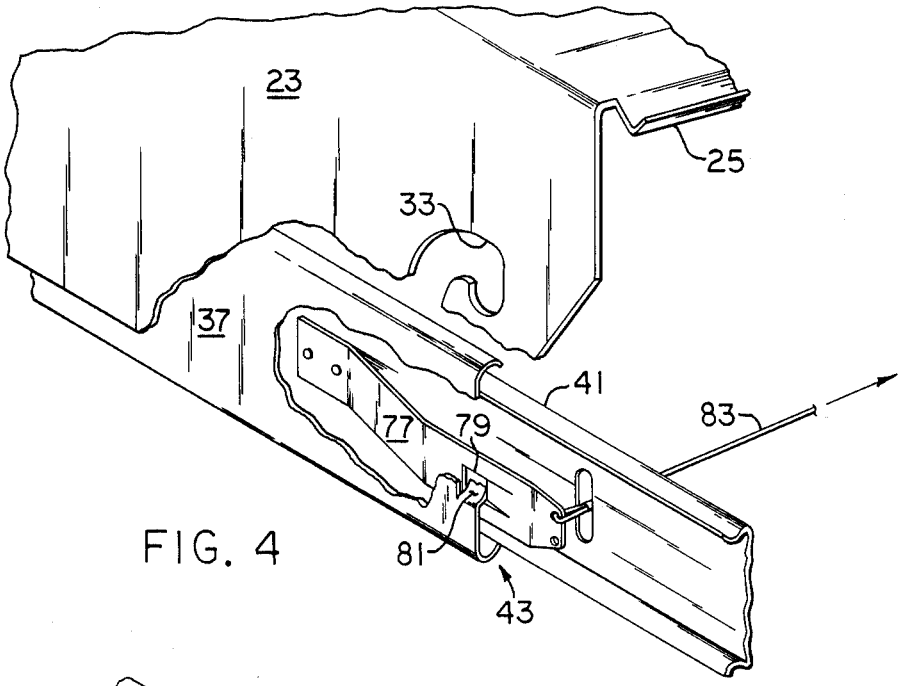
FIG. 4 is a partial perspective, with parts broken away, taken along line 4—4 of FIG. 1, illustrating the latch mechanism for latching the shelf in its extended position.
Figure 5:
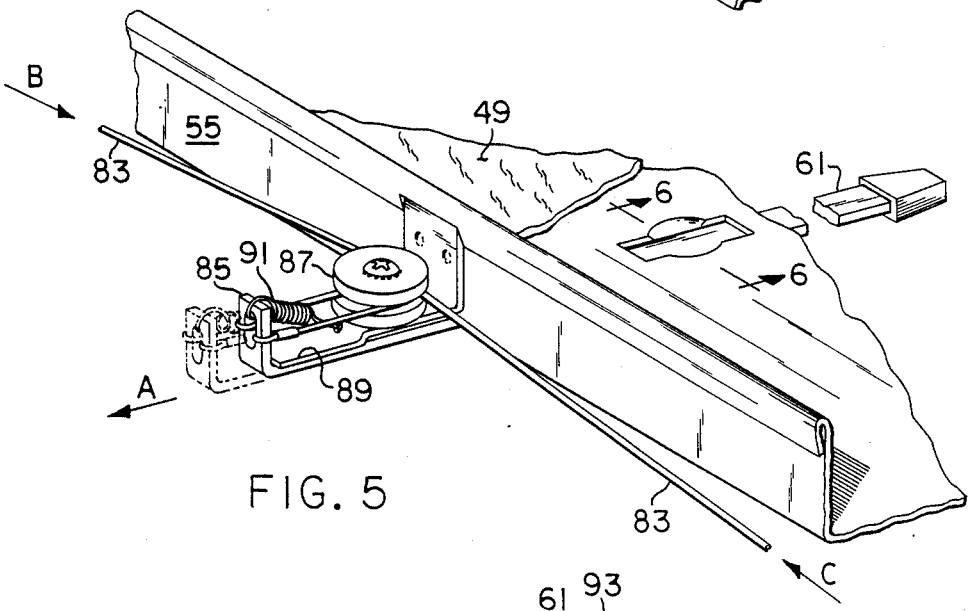
FIG. 5 is a partial perspective, with parts broken away, taken along line 5—5 of FIG. 1, illustrating the mechanism for releasing the latch of FIG. 4.

When released from its extended position, shelf 45 can be slid by means of the telescoping rails 41 and 37 to the position shown in FIG. 3 in which the keyboard or other contents of shelf 45 is protected by table top 15 when not in use. However, before the shelf can be slid to the position shown in FIG. 3, latch mechanism 43 (illustrated in more detail in FIG. 4) must be released. Latch mechanism 43 includes a cantilevered spring member 77 biased outwardly which includes an opening 79 into which a dimpled stop 81 of outer rail 37 may fall when the inner rail is in the fully extended position with respect to outer rail 37. Member 77 is suitably secured to inner rail 41 and is inclined slightly at its forward end to permit dimpled stop 81 to slide over member 77 until it reaches opening 79. At that point, stop 81 falls into opening 79 and secures the inner and outer rails 37 and 41 against further movement with respect to each other. The forward end of member 77 is secured to a cable 83 whose other end is secured to the releasing mechanism shown in FIG. 5. The releasing mechanisms includes lever 61 which is a bar which extends from the front of shelf 45 to the rear thereof, which bar at its end extends upwardly. In this upward extending portion, labelled 85, there is an opening by means of which cables 83 are secured to lever 61. Each cable 83 is made of steel and goes through a quarter turn around a cable bushing spool or pulley 87 mounted to a bracket 89 which is in turn mounted to the rear wall 55 of shelf 45. Spool 87 is provided so that movement of lever 61 in the direction indicated by the arrow labelled A in FIG. 5 results in the cables being moved in the directions labelled B and C in FIG. 5. Thus, when the lever 61 is moved to the position in which upwardly extending protion 85 is in the position shown in phantom shown in FIG. 5, the length of cable 83 between latching member 77 and spool 87 is shortened, which pulls latching member 77 out of engagement with dimpled stop 81. This frees the inner and outer rails for respective sliding motion and the shelf can thereupon be moved to the position shown in FIG. 3. Once lever 61 is released, a spring 91 secured between upwardly extending portion 85 of the lever and spool mounting bracket 89 causes the lever to be moved back to the position shown in solid lines in FIG. 5.

Figure 6:
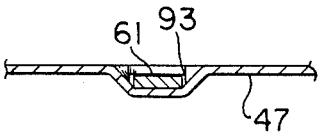
FIG. 6 is a sectional view taken along line 6—6 of FIG. 5.

FIG. 6 shows one of a pair of straps 93 formed from the bottom 47 of shelf 45 which support lever 61 generally below the bottom of the shelf. The straps define the path of travel when the lever is manually pressed inwardly or when it is forced back outwardly by the action of spring 91. Straps 93 are also shown in FIGS. 2 and 3.

Figure 7:
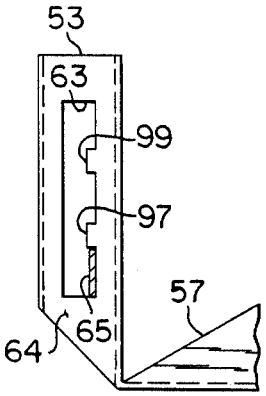
FIG. 7 is a sectional view taken along line 7—7 of FIG. 2 illustrating the level adjustment feature of the present invention.
Figure 8:
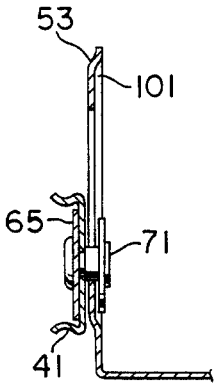
FIG. 8 is a sectional view taken along line 8—8 of FIG. 2.
Figure 9:
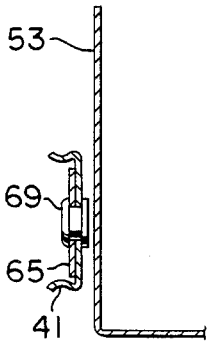
FIG. 9 is a sectional view taken along line 9—9 of FIG. 2.
Figure 10:
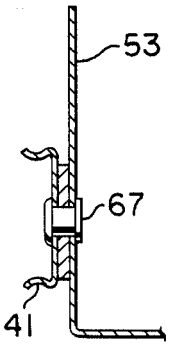
FIG. 10 is a sectional view taken along line 10—10 of FIG. 2.

Vertically stepped slot 63 is shown in more detail in FIG. 7. More specifically the slot 63 shown in FIG. 7 is that in the left hand sidewall 53 of shelf 45. Slot 63 in the right hand wall is the mirror image of this slot shown. Note that lever or member 65 is disposed against the right hand side of slot 63. Since the lever is preferably made of a fairly stiff material like sheet metal, it is biased into this rightmost position no matter which of the vertical steps it is engaged by at the time. In moving lever 65 from one step in the slot to another, it is necessary to move the lever to the left past one or both of a pair of protrusions 97 and 99. To ensure that the lever can be moved in this manner, the sidewall of the shelf includes a depression 101 (see FIGS. 2 and 8 which permit pin 71 to move in the required direction (i.e. left when we are talking about the left side of the shelf) sufficiently to allow the lever to clear the protrusion or protrusions. Furthermore, this motion is not in the least hindered by pin 69 since, as seen in FIG. 9, pin 61 has as its sole function securing lever 65 to inner rail 41 and it is in no way connected to the sidewall. The only connection between rail 41 and the corresponding sidewall (sidewall 53 in FIG. 10) which has little play is pivot pin 67. However, this pin is located so far toward the rear of shelf 45 that it does not hinder the desired movement of lever 65 from step to step of notch 63.

Figure 11:
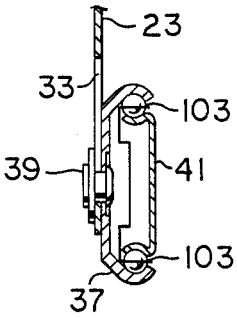
FIG. 11 is a sectional view taken along line 11—11 of FIG. 2.
Figure 12:
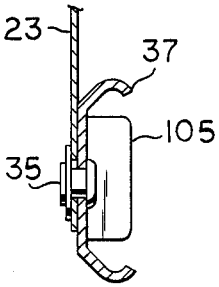
FIG. 12 is a sectional view taken along line 12—12 of FIG. 2.

Outer rail 37 (FIG. 11) includes a plurality of ball bearings 103 disposed in its channel above and below inner rail 41 to promote easy sliding movement of the inner rail with respect to the outer rail. Outer rail 37 also includes a stop 105 (FIG. 12) at its rearward end to prevent motion of the inner rail 41 past the end of outer rail 37.

In view of the above it will be seen that the various aspects and features of the invention are achieved and other advantageous results attained. The embodiment invention described herein is illustrative only and is not to be construed in a limiting sense.

I claim as my invention:

1. A retractable shelf assembly for a computer work station table and the like comprising:

(a) a housing adapted to be mounted beneath the top of a table, (b) a shelf sized to fit substantially within the housing;

(c) rail means for guiding movement of the shelf between a retracted position in which the shelf is substantially within the housing and an extended position in which the shelf has a substantial portion thereof outside the housing to provide a work surface spaced from the top of the table;

(d) pivot means securing the rail means to the housing for providing an axis about which the shelf may be rotated to change the height of the shelf with respect to the top of the table; and (e) means for securing the shelf in the extended position;

(f) one of the housing and the rail means having a vertically stepped slot therein including vertically spaced steps and the other of the housing and the rail means having a pin secured thereto and movable in said vertically stepped slot and selectively engageable with said vertically spaced steps to hold the shelf at predetermined heights with respect to the top of the table corresponding to the steps of the slot.

2. The shelf assembly as set forth in claim 1 further including:

(g) manually actuable means for releasing the shelf from the extended position to permit the shelf to be moved from the extended position to the retracted position within the housing.

3. The shelf assembly as set forth in claim 2 wherein:

(h) the means for securing the shelf in the extended position includes a latch member biased to latch the shelf in place whenever the shelf is in the extended position and wherein, (i) the releasing means when actuated overcomes the bias of the biased latch member to unlatch the shelf.

4. The shelf assembly as set forth in claim 3 wherein:

(j) the releasing means includes a spool fixedly secured to the shelf and a cable secured at one end to the biased member and at the other end to a manually operable lever movable with respect to the shelf, so that movement of the lever in a first direction with respect to the shelf changes the length of the cable between the spool and the biased member to withdraw the biased member from its biased position.

5. The shelf assembly as set forth in claim 4 further including:

(k) means for biasing the manually operable lever in a direction opposite the first direction, whereby the shelf is normally latched in placed when in the extended position.

6. The shelf assembly as set forth in claim 1 wherein:

(g) the pivot means includes a pivot pin attached to the rail means and the housing includes a horizontally extended slot in which the pivot pin is slidingly disposed, the horizontally extending slot being at least as long as the horizontal extent of the vertically stepped slot.

7. The shelf assembly as set forth in claim 6 wherein:

(h) the horizontally extending slot is disposed generally at the rear of the housing and the vertically stepped slot is disposed generally at the front of the housing.

8. A retractable shelf assembly for a computer work station table and the like comprising:

(a) a housing adapted to be mounted beneath the top of a table, (b) a shelf sized to fit substantially within the housing;

(c) rail means for guiding movement of the shelf between a retracted position in which the shelf is substantially within the housing and an extended position in which the shelf has a substantial portion thereof outside the housing to provide a work surface spaced from the top of the table;

(d) pivot means securing the rail means to the housing for providing an axis about which the shelf may be rotated to change the height of the shelf with respect to the top of the table;

(e) means for securing the shelf in the extended position;

(f) one of the housing and the rail means having a vertically stepped slot therein including vertically spaced steps and the other of the housing and the rail means having a pin secured thereto and movable in said vertically stepped slot and selectively engageable with said vertically spaced steps to hold the shelf at predetermined heights with respect to the top of the table corresponding to the steps of the slot; and (g) the rail means including a first pair of rails disposed in the vicinity of and operatively carried by the housing and a second pair of rails operatively carrying the shelf which telescope with respect to the first pair of rails between a retracted position in which the first and second rail pairs are substantially within the housing and an extended position in which the second pair of rails extends at least substantially outside the housing.

9. The shelf assembly as set forth in claim 8 wherein:

(h) each rail of the second pair rides in a channel of the corresponding rail of the first pair.

10. The shelf assembly as set forth in claim 8 wherein:

(h) the means for securing the shelf in its extended position includes means for locking the first and second rail pairs against relative movement when the second pair is in its extended position.

11. The shelf assembly as set forth in claim 10 further including:

(i) manually actuable means for releasing the locking means to permit the shelf and second rail pair to be moved from the extended position to the retracted position with the housing.

12. The shelf assembly as set forth in claim 8 wherein:

(h) the pivot means is disposed generally at the rear of the housing and secures the first rail pair to the housing.

13. The shelf assembly as set forth in claim 8 wherein:

(h) the vertically stepped slot is disposed in and generally at the front of the housing and the pin is fixedly secured to a rail of the first pair.

14. A retractable shelf assembly for a computer work station table and the like comprising:

(a) a housing adapted to be mounted beneath the top of a table, (b) a shelf sized to fit substantially within the housing;

(c) rail means for guiding movement of the shelf between a retracted position in which the shelf is substantially within the housing and an extended position in which the shelf has a substantial portion thereof outside the housing to provide a work surface spaced from the top of the table;

(d) pivot means securing the rail means to the housing for providing an axis about which the shelf may be rotated to change the height of the shelf with respect to the top of the table;

(e) means for securing the shelf in the extended position;

(f) one of the housing and the rail means having a vertically stepped slot therein including vertically spaced steps and the other of the housing and the rail means having a pin secured thereto and movable in said vertically stepped slot and selectively engageable with said vertically spaced steps to hold the shelf at predetermined heights with respect to the top of the table corresponding to the steps of the slot;

(g) the rail means including a first pair of rails disposed in the vicinity of and operatively carried by the housing and a second pair of rails operatively carrying the shelf which telescope with respect to the first pair of rails between a retracted position in which the first and second rail pairs are substantially within the housing and an extended position in which the second pair of rails extends at least substantially outside the housing, (h) means for adjusting the angle the shelf makes with respect to the second pair of rails.

15. A retractable shelf assembly for a computer work station table and the like comprising:

(a) a housing adapted to be mounted beneath the top of a table, (b) a shelf sized to fit substantially within the housing;

(c) rail means for guiding movement of the shelf between a retracted position in which the shelf is substantially within the housing and an extended position in which the shelf has a substantial portion thereof outside the housing to provide a work surface spaced from the top of the table;

(d) pivot means securing the rail means to the housing for providing an axis about which the shelf may be rotated to change the height of the shelf with respect to the top of the table;

(e) means for securing the shelf in the extended position;

(f) one of the housing and the rail means having a vertically stepped slot including vertically spaced steps therein and the other of the housing and the rail means having a pin secured thereto and movable in said vertically stepped slot and selectively engageable with said vertically spaced steps to hold the shelf at predetermined heights with respect to the top of the table corresponding to the steps of the slot; and (g) the shelf including a second vertically stepped slot with a plurality of steps, and (h) the rail means being pivotally connected to the shelf and including a member fixed with respect to the rail means, said member being spaced from the pivot connection and manually movable with respect to the shelf into engagement with the steps of the second vertically stepped slot to adjust the angle of the shelf with respect to the top of the table.

* * * * *